US005754209A

United States Patent [19]

Thomas, Jr. et al.

[11] Patent Number: 5,754,209

[45] Date of Patent: May 19, 1998

[54] PRINTING METHOD FOR PRODUCING GRADIENT IMAGES

[75] Inventors: Jule William Thomas, Jr.; Bernard Allen Apple, both of Hendersonville, N.C.

[73] Assignee: Sterling Diagnostic Imaging, Inc., Glasgow, Del.

[21] Appl. No.: 742,165

[22] Filed: Nov. 1, 1996

[51] Int. Cl.[6] ..... B41J 2/01; B41J 2/05

[52] U.S. Cl. ..... 347/103; 347/88; 347/20

[58] Field of Search ..... 347/101, 103, 347/88, 95, 99, 20

[56] References Cited

U.S. PATENT DOCUMENTS

| | | | |
|---|---|---|---|
| 4,713,701 | 12/1987 | Kawamura et al. | 358/298 |
| 4,713,746 | 12/1987 | Watanabe et al. | 346/1.1 |
| 4,727,436 | 2/1988 | Kawamura et al. | 358/298 |
| 4,860,026 | 8/1989 | Matsumoto et al. | 346/1.1 |
| 5,142,374 | 8/1992 | Tajika et al. | 358/298 |
| 5,276,468 | 1/1994 | Deur et al. | 346/140 |
| 5,372,852 | 12/1994 | Titterington et al. | 427/288 |

FOREIGN PATENT DOCUMENTS

| | | |
|---|---|---|
| 0566259 | 10/1993 | European Pat. Off. . |
| 0604025 | 6/1994 | European Pat. Off. . |

*Primary Examiner*—Benjamin R. Fuller
*Assistant Examiner*—Juanita Stephens
*Attorney, Agent, or Firm*—Joseph T. Guy, Jr.

[57] ABSTRACT

The present invention describes an apparatus for recording a gradient image on transparent media comprising: at least one solid phase change ink; a solid null image element; a heating system capable of melting the solid phase change ink to form a molten phase change ink and capable of melting the solid null image element to form a molten null image element; a printing head capable of receiving the molten phase change ink and the molten null image element and depositing them in an imagewise pattern onto a transfer surface; a transfer surface capable of receiving the imagewise pattern; a cooling mechanism for cooling the molten phase change ink and the molten null image element in the imagewise pattern to form a malleable phase change ink and a malleable null image element in the imagewise pattern on the transfer surface; a media; a transfer mechanism capable of transferring said malleable phase change ink and said malleable null image element in said imagewise pattern on said transfer surface to said media.

19 Claims, 3 Drawing Sheets

CASE #1

CASE #2

PRINTING METHOD FOR PRODUCING GRADIENT IMAGES

FIELD OF INVENTION

The present invention is related to a method for printing gradient images using phase change ink with discrete drop size. More specifically, the present invention is related to an apparatus and method for printing an image with a high gradient and excellent resolution without substantial compromises in physical stability of the image.

BACKGROUND OF THE INVENTION

Many methods have been proposed for the generation of gradient images from discrete dots of ink.

Combinations of different density solvent based inks in an ink jet printing method have been shown to be a suitable approach to the generation of high gradient images from a discrete number of inks. U.S. Pat. Nos. 4,727,436; 4,860,026; 5,142,374; 4,713,746; and 4,713,701 all teach variations on methods and apparatus for combining inks. Suitable gradients are available using these and other techniques. Even with suitable gradients the image quality is still unsuitable due to image dot spreading which occurs as a result of the carrier solvent, such as water or an organic, and the ink diffusing into the media. Another major disadvantage of solvent based ink jet systems is the solvent which must be absorbed by the media or evaporated after printing. Evaporation of the solvent is environmentally unsatisfactory particularly when non-aqueous solvents are employed. It has been a long standing goal of skilled artisans to decrease the amount of ink used to form an image which, in-turn, decreases the image dot spread and lowers cost.

Phase change ink printing provides some advantages over solvent based ink jet systems. Specifically, there is no solvent since the phase change ink is a solid at room temperature and a liquid at coating temperatures. One disadvantage of phase change ink printing is the inability to easily vary drop size on demand. Discrete drop sizes limit the gradient levels available with conventional phase change ink printing methods due to the lack of continuously variable ink density levels. Phase change ink printing does allow for the placement of multiple dots at a given position which increases the contrast available to some extent. When multiple dots are applied image resolution and image durability deteriorate due to the appearance of ink islands occurring as a result of the stacking of solid ink. Phase change inks and printing techniques are described, for instance, in U.S. Pat. Nos. 5,372,852 and 5,276,468 and in European Patent Applications 0 566 259 and 0 604 025.

It would be highly advantageous to combine the dry printing capabilities of phase change ink printing with the ink combining methods of solvent based ink jet printing to achieve a superior print with high resolution and contrast. Efforts towards this goal have been thwarted and the method has been considered to be abandoned by skilled artisans due to the loss of resolution and poor image durability resulting from the ink islands.

The present invention provides a method for eliminating the problems associated with combining phase change inks of different densities. The resulting image exhibits excellent gradation without discontinuities and provides a superior method of printing.

SUMMARY OF THE INVENTION

It is an object of the present invention to provide a printing system which provides an image with the appearance of continuous gradients from discrete ink drops.

It is another object of the present invention to provide an imaging system which is durable and less susceptible to physical deterioration resulting from abrasion.

It is yet another object of the present invention to provide an imaging system which does not require the absorption, or evaporation of solvents.

These and other advantages, as will be apparent, are provided in an apparatus for recording a gradient image on transparent media comprising: at least one solid phase change ink; a solid null image element; a heating system capable of melting the solid phase change ink to form a molten phase change ink and capable of melting the solid null image element to form a molten null image element; a printing head capable of receiving the molten phase change ink and the molten null image element and depositing them in an imagewise pattern onto a transfer surface; a transfer surface capable of receiving the imagewise pattern; a cooling mechanism for cooling the molten phase change ink and the molten null image element in the imagewise pattern to form a malleable phase change ink and a malleable null image element in the imagewise pattern on the transfer surface; a media; a transfer mechanism capable of transferring said malleable phase change ink and said malleable null image element in said imagewise pattern on said transfer surface to said media.

A particularly preferred embodiment is provided in an apparatus for recording a gradient image on media comprising: a set of solid phase change inks comprising: a first solid phase change ink with an optical density defined by the formula:

$$P_1 \leqq N_a \cdot n \cdot m \cdot P_n + D;$$

a second solid phase change ink with an optical density ($P_2$) defined by the formula:

$$P_2 \leqq N_a \cdot n \cdot m \cdot P_n + N_1 \cdot n \cdot m \cdot P_1 + D; \text{ and}$$

a third imaging ink has an optical density ($P_3$) defined by the formula:

$$P_3 \leqq N_a n \cdot m \cdot P_n + N_1 \cdot n \cdot m \cdot P_1 + N_2 \cdot n \cdot m \cdot P_2 + D;$$

a solid null image element;

a heating system capable of melting the set of solid phase change inks to form a set of molten phase change inks and melting the solid null image element to form a molten null image element; a printing head capable of receiving the set of molten phase change inks and the molten null image element and depositing the set of molten phase change inks and the molten null image element in a molten imagewise pattern; a transfer surface capable of receiving the molten imagewise pattern from the printing head; a cooling mechanism for cooling said molten imagewise pattern to form a malleable imagewise pattern on the transfer surface; a media; and a transfer mechanism capable of transferring the malleable imagewise pattern to the media.

Another preferred embodiment is provided in an apparatus for recording a gradient image on media comprising: a set of solid phase change inks comprising: a first solid phase change ink with an optical density of at least 0.08 to no more than 0.40 for a 19 μm thick drop; a second solid phase change ink has an optical density has an optical density of more than 0.40 to no more than 0.90 for a 19 μm thick drop; a third imaging ink has an optical density of at least 1.2 to 5.0 for a 19 μm thick drop; a solid null image element wherein said null image element has an optical density of less than 0.15 for a 19 μm thick drop; a heating system capable of melting said set of solid phase change inks to form a set of molten phase change inks and melting said solid null image element to form a molten null image element; a printing head capable of receiving said set of molten phase change inks and said molten null image element and depositing said set of molten phase change inks and said molten null image element in a molten imagewise pattern; a transfer surface capable of receiving said molten imagewise pattern from said printing head; a cooling mechanism for cooling said molten imagewise pattern to form a malleable imagewise pattern on said transfer surface; a media; and a transfer mechanism capable of transferring said malleable imagewise pattern on said transfer surface to said media.

DETAILED DESCRIPTION OF THE INVENTION

Throughout the following descriptions similar elements are so numbered in the figures.

Figure 1:
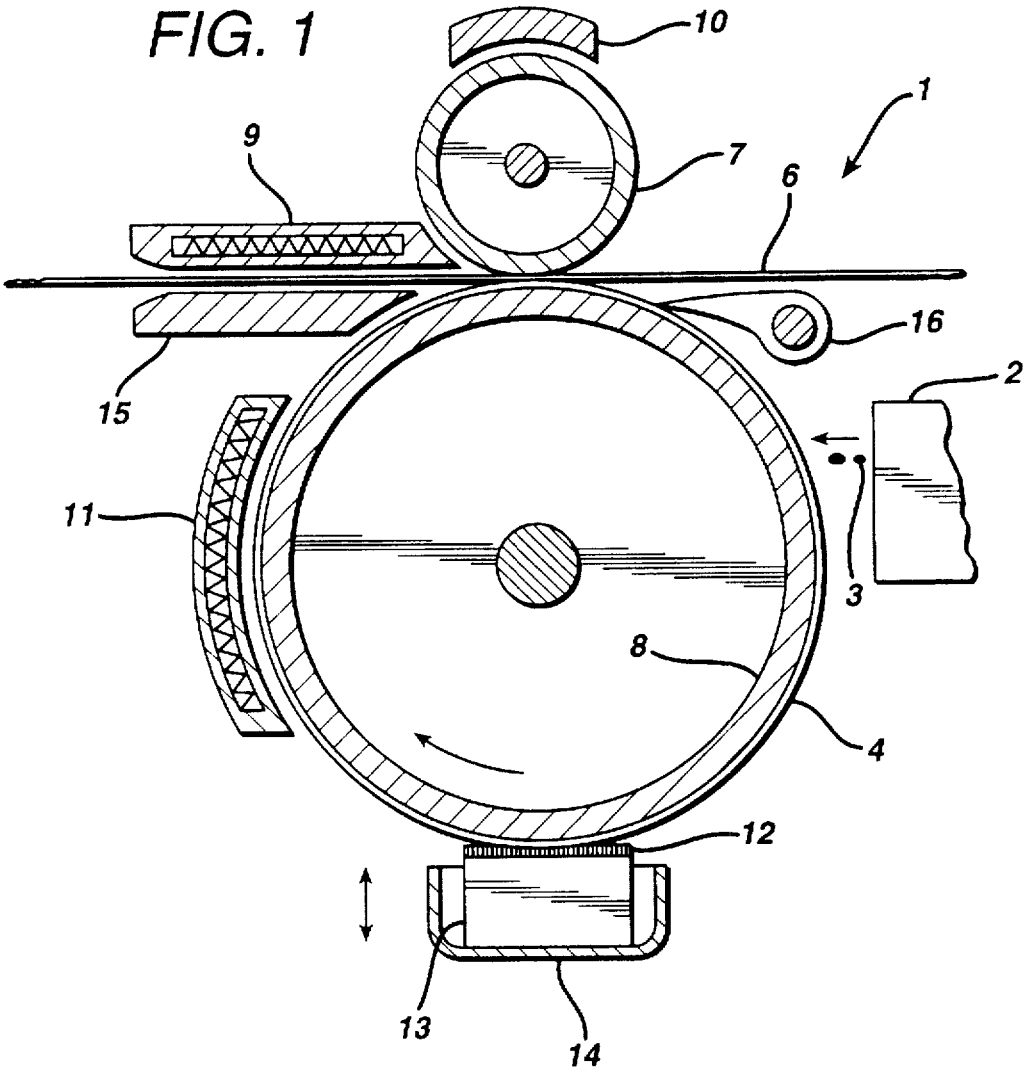
FIG. 1 is a diagrammatic illustration of the phase change printing apparatus.
Figure 2:
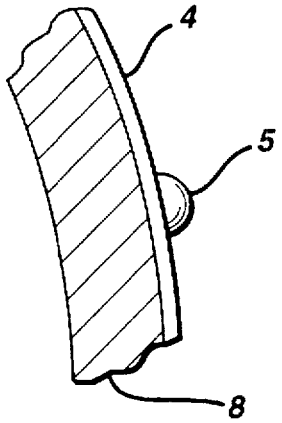
FIG. 2 is an enlarged diagrammatic illustration of the phase change ink on the liquid layer intermediate transfer surface.

FIG. 1 is a diagrammatic illustration of the phase change printing apparatus and FIG. 2 is an enlargement illustrating a single ink droplet on the surface of the liquid layer. In FIG. 1 the system, generally referred to as 1, comprises a printhead, 2. The ink is melted from the solid form to a molten state by the application of heat energy to raise the temperature to a level of from about 85° C. to about 150° C. Temperatures above 150° C. are avoided due to the onset of degradation of the ink by chemical breakdown. The molten ink is expelled as a droplet, 3, to the exposed surface of the liquid layer, 4. The liquid layer forms the intermediate transfer surface on the drum, 8. The liquid layer is applied by an applicator, 12, connected to a web applicator support, 13, contained within retractable applicator apparatus, 14. The molten ink is cooled to an intermediate temperature and solidified to a malleable state seen as ink drop, 5, of FIG. 2. The intermediate temperature where the solidified ink is maintained in its malleable state is preferably between about 30° C. and about 80° C. The ink drop is then transferred to the media, 6, via a contact transfer by entering the nip between the fusing roller, 7, and the liquid layer, 4. A stripper, 16, only one of which is shown, assist in stripping the media from the liquid layer.

Once the malleable ink image enters the nip it adheres, or is fixed, to the media, 6, either by the pressure exerted against the ink image on the media, 6, or by the pressure exerted by the fusing roller, 7, or by the combination of the pressure and heat supplied by an optional heating apparatus, 9. Additional heating apparatus, 10 and 11, could optionally be employed to supply heat to facilitate the process of transferring the malleable ink to the media. The media is directed with the assistance of a guide, 15.

The pressure exerted on the ink image is between about 10 to about 2000 pounds per square inch (psi), more preferably between about 750 psi to about 850 psi. The pressure must be sufficient to have the ink image adhere to the media, 6, and be sufficiently deformed to ensure that light is transmitted through the ink rectilinearly or without significant deviation in its path from the inlet to the outlet. This is particularly important in the present invention since a major advantage of the present invention is the ability to print on transparency media. Once the ink is adhered to the media the ink image is cooled to ambient temperature of about 20° C. to about 25° C. The ink comprising the image must be ductile, or be able to yield or experience plastic deformation without fracture when kept above the transition temperature. Below the glass transition temperature the ink is brittle. The temperature of the ink image in the ductile state is between −10° C. and about the melting point, or less than about 85° C.

Figure 3:
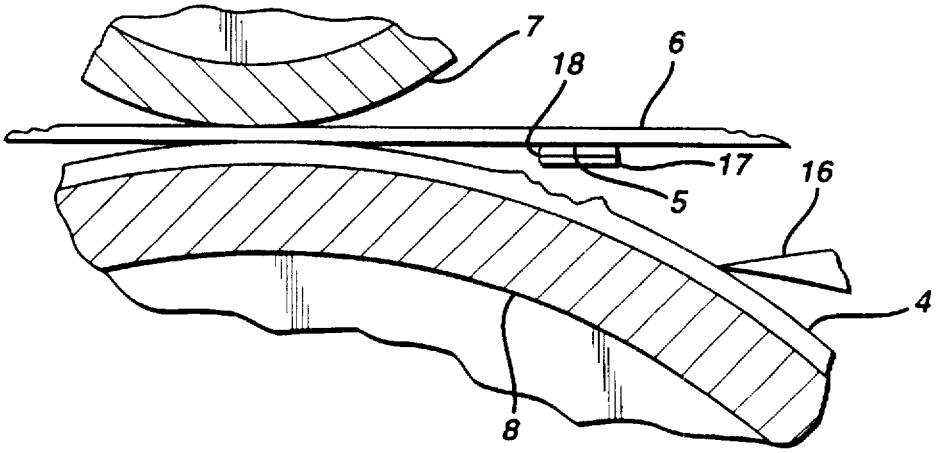
FIG. 3 PRIOR ART
FIG. 3 is an enlarged diagrammatic illustration of the prior art transfer of the phase change ink image onto the media.

FIG. 3 is an enlarged diagram illustrating the transfer of inked image from the liquid transfer surface to the media as employed in the prior art. In FIG. 3, the ink drop is deformed to its final conformation, 17. Each addressable location is defined as a subpixel. A multiplicity of subpixels are taken together to define a superpixel. It is apparent in FIG. 3 that the ink image comprises a relief, 18, the thickness of which depends on the amount of ink deposited on the media. If the thickness of the relief becomes to large the ink image becomes unstable and the resolution deteriorates due to collapsing of the relief and spreading of the phase change ink over a larger area. Yet another problem with the relief is the integrity of the image. The relief edge increases the mechanical stresses to which the ink image are susceptible and stripping the ink image from the media commonly results with abrasion. Prior art printing procedures limited the thickness of the relief to decrease the detrimental effects of relief destruction and degradation.

If multiple drops of ink are applied to the media in a single location the thickness of the relief image increases in proportion to the number of drops which exaggerates the problems described previously.

The present invention solves these problems and provides a printing method which allows for the use of multiple density inks which can be combined to form a gradient image.

Figure 4:
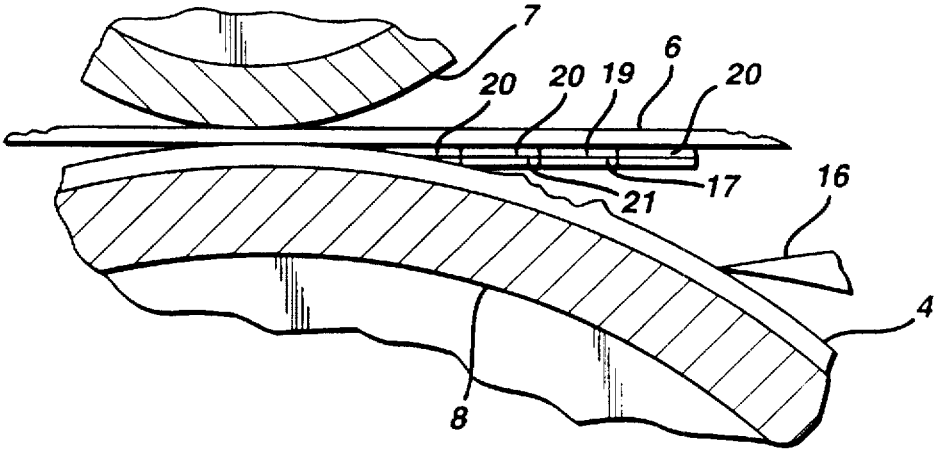
FIG. 4 is an enlarged diagrammatic illustration of the transfer of the phase change ink image onto the media in accordance with the present invention.

FIG. 4, illustrates an embodiment of the present invention wherein the image element, 19, is stabilized by null image elements 20, deformed to the transparent image, 21. The null image element removes the relief and stabilizes the image element, 19, from the problems associated with relief destruction. The null image element also increases the apparent image quality due to the reduction in image parallax. The effect of image parallax on image quality was previously not appreciated.

By incorporating an additional null image element the thickness of the image can be increased while, at the same time, avoiding the problems associated with relief images.

The size of the phase change ink drop is chosen as a compromise between printing efficiency and resolution. A large drop tends towards increasing printing efficiency at the expense of resolution and a smaller drop tends towards increasing resolution at the expense of printing efficiency. Another concern is the degree of deformation of the phase change ink drop in the nip as the phase change ink is adhered to the surface of the media. Preferably, the phase change ink drop is between 10 nanograms and 150 nanograms in mass. Most preferably the phase change ink drop is 20–50 nanograms in mass. For the purposes of comparison a 35 nanogram phase change ink drop, with a density (g/ml) of approximately 1.0, printed to a resolution of 600 drops per inch by 600 drops per inch will have a thickness of approximately 19 μm. For purposes of clarity the optical density will be reported herein for a phase change ink drop of 19 μm. The optical density for other thicknesses can be determined using Beers Law. Beers Law applies to transmitted images printed in the manner described herein. All optical densities reported herein are specifically transmitted optical densities.

The null image element is characterized as a phase change ink which is substantially void of colorants, or pigmentation as represented by an optical density. For the purposes of definition the term "substantially void of colorants, or pigmentation as represented by optical density" refers specifically to a phase change ink wherein the optical density of a 19 μm thick drop is less than 0.15. More preferably, the null image element has an optical density of less than 0.1 for a 19 μm thick drop and most preferably the null image element has an optical density of less than 0.075 for a 19 μm thick drop.

The null image element is applied to the media at any point characterized in the print algorithm as void of ink or those areas corresponding to minimum optical density. In the present invention the entire image is preferably printed with some combination of null image element for the low optical density regions and imaging inks for the high optical density regions. It is preferred that at least 70% of the image area is printed. Preferably at least 85% of the image area is printed and most preferably at least 95% of the image area is printed. It is preferable that the null image element is used to fill the image such that no two adjacent subpixels differ in thickness by more than the thickness of two phase change ink drops. More preferably, the null image element is used to fill the image such that no two adjacent subpixels differ in thickness by more than the thickness of one phase change ink drop.

It is conventional in the art to utilize a multiplicity of jets in the formation of an image. Each jet utilizes a unique phase change ink with a specific optical density. For the purposes of the present invention it is contemplated that at least three jets, more preferably four, will be employed in a phase change ink printer with one jet printing the null image element and two jets, or more preferably three, printing different density inks to achieve a gradient image. In practice, each jet typically prints one drop per subpixel per pass. Therefore, for a conventional configuration with four ink jets as many as four drops of ink can be deposited on a single subpixel in a single pass. For convenience, and printing efficiency, it is preferred that only two drops be deposited in a single subpixel which decreases the choice of ink optical densities which can be successfully employed. It is critical in high quality imaging to avoid discontinuities in the gradient. The choice of ink optical densities is also limited by the demand to generate a continuous gradient scale defined as a scale with a maximum deviation between adjacent optical densities of no more than 0.01. A deviation between adjacent optical densities of more than 0.01 becomes observable to the naked eye and does not appear as a continuous gradient image. More preferably, the maximum deviation between adjacent optical densities is no more than 0.008 and most preferably no more than 0.005 at low optical densities.

Taking the image limitations into consideration the optical densities of the imaging inks are bound by the following embodiments.

Preferably, the imaging inks comprise a first imaging ink, a second imaging ink and a third imaging ink. The first imaging ink preferably has an optical density of at least 0.08 and no more than 0.40 for a 19 μm thick drop. More preferably the first imaging ink has an optical density of at least 0.20 and no more than 0.40 for a 19 μm thick drop. The second imaging ink preferably has an optical density of more than 0.40 and no more than 0.90 for a 19 μm thick drop. More preferably the second imaging ink has an optical density of more than 0.70 and no more than 0.90 for a 19 μm thick drop. The third imaging ink preferably has an optical density of at least 1.2 to 5.0 for a 19 μm thick drop and more preferably the third imaging ink has an optical density of at least 1.2 to 2.0 for a 19 μm thick drop. To avoid discontinuities in the gradients each subsequent imaging ink must be able to provide a density which overlaps with the density available from the imaging inks of lower density. When a dither pattern is used each subsequent ink can be no higher in optical density than the optical density of a single drop divided by the dither matrix size.

By way of example; a first imaging ink with an optical density of 0.3 at a given drop size, used in a 2×2 dither matrix, with two passes can provide an optical density up to 0.6. In this example, each subpixel of the 2×2 dither matrix would comprise two drops of the first imaging ink. A second imaging ink would have to be able to provide a density of 0.6±maximum deviation between adjacent densities. Since the densities of the four subpixels of a 2×2 dither matrix are averaged to obtain the density of the superpixel a single drop in one subpixel of the 2×2 dither matrix would be restricted to a density of no more than 4 times the minimum density or 2.4 since averaging a single dot of density 2.4 over four subpixels would provide a density for the superpixel of 0.6.

In general, the determination of imaging ink densities can be determined by the following algorithms taking into consideration the following terms.

D is the maximum deviation between optical density steps allowable;

$P_n$ is the optical density of the null image element;

$N_a$ is the number of ink drops allowed per subpixel for each ink (a); and n and m taken together multiplicitivly define the number of subpixels per superpixel.

For the first imaging ink the optical density ($P_1$) is chosen as:

$$P_1 \leqq N_a \cdot n \cdot m \cdot P_n + D$$

For the second imaging ink the optical density ($P_2$) is chosen as:

$$P_2 \leqq N_a \cdot n \cdot m \cdot P_n + N_1 \cdot n \cdot m \cdot P_1 + D.$$

For the third imaging ink the optical density ($P_3$) is chosen as:

$$P_3 \leqq N_a \cdot n \cdot m \cdot P_n + N_1 \cdot n \cdot m \cdot P_1 + N_2 \cdot n \cdot m \cdot P_2 + D.$$

Phase change inks are characterized, in part, by their propensity to remain in the solid phase at ambient temperature and in the liquid phase at elevated temperatures in the printing head. The ink is heated to form the liquid phase and droplets of liquid ink are ejected from the printing head onto the transfer surface. The transfer surface is maintained at a temperature which is suitable for maintaining the phase change ink in a rubbery, or malleable state. The ink droplets are then transferred to the surface of the printing media and the phase change ink is allowed to solidify to form a pattern of solid ink drops.

Exemplary phase change ink compositions comprise the combination of a phase change ink carrier and a compatible colorant.

Exemplary phase change ink colorants comprise a phase change ink soluble complex of (a) a tertiary alkyl primary amine and (b) dye chromophores having at least one pendant acid functional group in the free acid form. Each of the dye chromophores employed in producing the phase change ink colorants are characterized as follows: (1) the unmodified counterpart dye chromophores employed in the formation of the chemical modified dye chromophores have limited solubility in the phase change ink carrier compositions, (2) the chemically modified dye chromophores have at least one free acid group, and (3) the chemically modified dye chromophores form phase change ink soluble complexes with tertiary alkyl primary amines. For example, the modified phase change ink colorants can be produced from unmodified dye chromophores such as the class of Color Index dyes referred to as Acid and Direct dyes. These unmodified dye chromophores have limited solubility in the phase change ink carrier so that insufficient color is produced from inks made from these carriers. The modified dye chromophore preferably comprises a free acid derivative of a xanthene dye.

The tertiary alkyl primary amine typically includes alkyl groups having a total of 12 to 22 carbon atoms, and preferably from 12 to 14 carbon atoms. The tertiary alkyl primary amines of particular interest are produced by Rohm and Haas Texas, Incorporated of Houston, Tex. under the tradenames Primene JMT and Primene 81-R. Primene 81-R is a particularly suitable material. The tertiary alkyl primary amine of this invention comprises a composition represented by the structural formula:

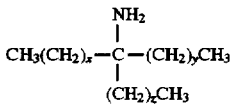

wherein:

x is an integer of from 0 to 18;

y is an integer of from 0 to 18; and z is an integer of from 0 to 18;

with the proviso that the integers x, y and z are chosen according to the relationship:

x+y+z=8 to 18.

An exemplary phase change ink carrier comprises a fatty amide containing material. The fatty amide-containing material of the phase change ink carrier composition may comprise a tetraamide compound. Particularly suitable tetra-amide compounds for producing phase change ink carrier compositions are dimeric acid-based tetra-amides including the reaction product of a fatty acid, a diamine such as ethylene diamine and a dimer acid. Fatty acids having from 10 to 22 carbon atoms are suitable in the formation of the dimer acid-based tetra-amide. These dimer acid-based tetramides are produced by Union Camp and comprise the reaction product of ethylene diamine, dimer acid, and a fatty acid chosen from decanoic acid, myristic acid, stearic acid and docosanic acid. Dimer acid-based tetraamide is the reaction product of dimer acid, ethylene diamine and stearic acid in a stoichiometric ratio of 1:2:2, respectively. Stearic acid is a particularly suitable fatty acid reactant because its adduct with dimer acid and ethylene diamine has the lowest viscosity of the dimer acid-based tetra-amides.

The fatty amide-containing material can also comprise a mono-amide. The phase change ink carrier composition may comprise both a tetra-amide compound and a mono-amide compound. The mono-amide compound typically comprises either a primary or secondary mono-amide. Of the primary mono-amides stearamide, such as Kemamide S, manufactured by Witco Chemical Company, can be employed herein. The mono-amides behenyl behemamide and stearyl stearamide are extremely useful secondary mono-amides. Stearyl stearamide is the mono-amide of choice in producing a phase change ink carrier composition.

Another way of describing the secondary mono-amide compound is by structural formula. More specifically, the secondary mono-amide compound is represented by the structural formula:

$$C_xH_y—CO—NHC_aH_b$$

wherein:

x is an integer from 5 to 21;

y is an integer from 11 to 43;

a is an integer from 6 to 22; and b is an integer from 13 to 45.

The fatty amide-containing compounds comprise a plurality of fatty amide materials which are physically compatible with each other. Typically, even when a plurality of fatty amide-containing compounds are employed to produce the phase change ink carrier composition, the carrier composition has a substantially single melting point transition. The melting point of the phase change ink carrier composition is most suitably at least about 70° C.

The phase change ink carrier composition may comprise a tetra-amide and a mono-amide. The weight ratio of the tetraamide to the mono-amide is from about 2:1 to 1:10.

Modifiers such as tackifiers and plasticizers may be added to the carrier composition to increase the flexibility and adhesion. The tackifiers of choice are compatible with fatty amide-containing materials. These include, for example, Foral 85, a glycerol ester of hydrogenated abietic acid, and Foral 105, a pentaerythritol ester of hydroabietic acid, both manufactured by Hercules Chemical Company; Nevtac 100 and Nevtac 80 which are synthetic polyterpene resins manufactured by Neville Chemical Company; Wingtack 86, a modified synthetic polyterpene resin manufactured by Goodyear Chemical Company, and Arakawa KE 311, a rosin ester manufactured by Arakawa Chemical Company. Arakawa KE 311, is a particularly suitable tackifier for use phase change ink carrier compositions.

Plasticizers may be added to the phase change ink carrier to increase flexibility and lower melt viscosity. Plasticizers which have been found to be advantageous in the composition include dioctyl phthalate, diundecyl phthalate, alkylbenzyl phthalate (Santicizer 278) and triphenyl phosphate, all manufactured by Monsanto Chemical Company; tributoxyethyl phosphate (KP-140) manufactured by FMC Corporation; dicyclohexyl phthalate (Morflex 150) manufactured by Morflex Chemical Company Inc.; and trioctyl trimellitate, manufactured by Kodak. However, Santicizer 278 is a plasticizer of choice in producing the phase change ink carrier composition.

Other materials may be added to the phase change ink carrier composition. In a typical phase change ink carrier composition antioxidants are added for preventing discoloration. Antioxidants include Irganox 1010, manufactured by Ciba Geigy, Naugard 76, Naugard 512, and Naugard 524, all manufactured by Uniroyal Chemical Company.

A particularly suitable phase change ink carrier composition comprises a tetra-amide and a mono-amide compound, a tackifier, a plasticizer, and a viscosity modifying agent. The compositional ranges of this phase change ink carrier composition are typically as follows: from about 10 to 50 weight percent of a tetraamide compound, from about 30 to 80 weight percent of a mono-amide compound, from about 0 to 25 weight percent of a tackifier, from about 0 to 25 weight percent of a plasticizer, and from about 0 to 10 weight percent of a viscosity modifying agent.

The transmission spectra for each of the phase change inks can be evaluated on a commercially available spectrophotometer, the ACS Spectro-Sensor II, in accordance with the measuring methods stipulated in ASTM E805 (Standard Practice of Instrumental Methods of Color or Color Difference Measurements of Materials) using the appropriate calibration standards supplied by the instrument manufacturer. For purposes of verifying and quantifying the overall calorimetric performance, measurement data are reduced, via tristimulus integration, following ASTM E308 (Standard Method for Computing the Colors of Objects using the CIE System) in order to calculate the 1976 CIE L* (Lightness), a* (redness-greeness), and b* (yellownessblueness), (CIELAB) values for each phase change ink sample. In addition, the values for CIELAB Psychometric Chroma, C* sub ab, and CIELAB Psychometric Hue Angle, h sub ab were calculated according to publication CIE 15.2, Colorimetry (Second Edition, Central Bureau de la CIE, Vienna, 1986).

The nature of the phase change ink carrier composition is chosen such that thin films of substantially uniform thickness exhibit a relatively high L* value. For example, a substantially uniform thin film of about 20–70 μm thickness of the phase change ink carrier preferably has an L* value of at least about 65.

The phase change ink carrier composition forms an ink by combining the same with a colorant. A subtractive primary colored phase change ink will be formed by combining the ink carrier composition with compatible subtractive primary colorants. The subtractive primary colored phase change inks comprise four component dyes, namely, cyan, magenta, yellow and black. The subtractive primary colorants comprise dyes from either class of Color Index (C.I.) Solvent Dyes and Disperse Dyes. Employment of some C.I. Basic Dyes can also be successful by generating, in essence, an in situ Solvent Dye by the addition of an equimolar amount of sodium stearate with the Basic Dye to the phase change ink carrier composition. Acid Dyes and Direct Dyes are also compatible to a certain extent.

The phase change inks formed therefrom have, in addition to a relatively high L* value, a relatively high $C^*_{ab}$ value when measured as a thin layer of substantially uniform thickness as applied to a substrate. A reoriented layer of the phase change ink composition on a substrate has a $C^*_{ab}$ value, as a substantially uniform thin film of about 20 μm thickness, of subtractive primary yellow, magenta and cyan phase change ink compositions, which are at least about 40 for yellow ink compositions, at least about 65 for magenta ink compositions, and at least about 30 for cyan ink compositions.

The thickness of the liquid layer forming the intermediate transfer surface on the drum can be measured, such as by the use of reflectance Fourier Transform infrared spectroscopy or a laser interferometer. It is theorized that the thickness can vary from about 0.05 microns to about 60 microns, most preferably, from about 1 micron to about 10 microns. The thickness of the layer forming the intermediate transfer surface can increase if rougher surfaced supporting surfaces or drums are employed. The surface topography of the supporting surface or drum can have a roughness average ($R_n$) of from about 1 microinch to about 100 microinchs and more preferably from about 5 to about 15 microinches.

Suitable liquids that may be employed as the intermediate transfer surface include water, fluorinated oils, glycol, surfactants, mineral oil, silicone oil, functional oils, such as mercaptosilicone oils, fluorinated silicone oils and the like, or combinations thereof.

The following examples are illustrative of the invention and are not intended to limit the invention in any manner.

EXAMPLES

The following cases demonstrate the gray levels available given a wherein the superpixel is defined by four subpixels in a 2×2 arrangement. Single layer ink optical densities of 0.02, 0.08, 0.36 and 1.6 are employed in both cases. The maximum optical density is reached with two drop of the highest density and one drop of the next highest density in a single subpixel.

Comparative Case #1

Figure 5:
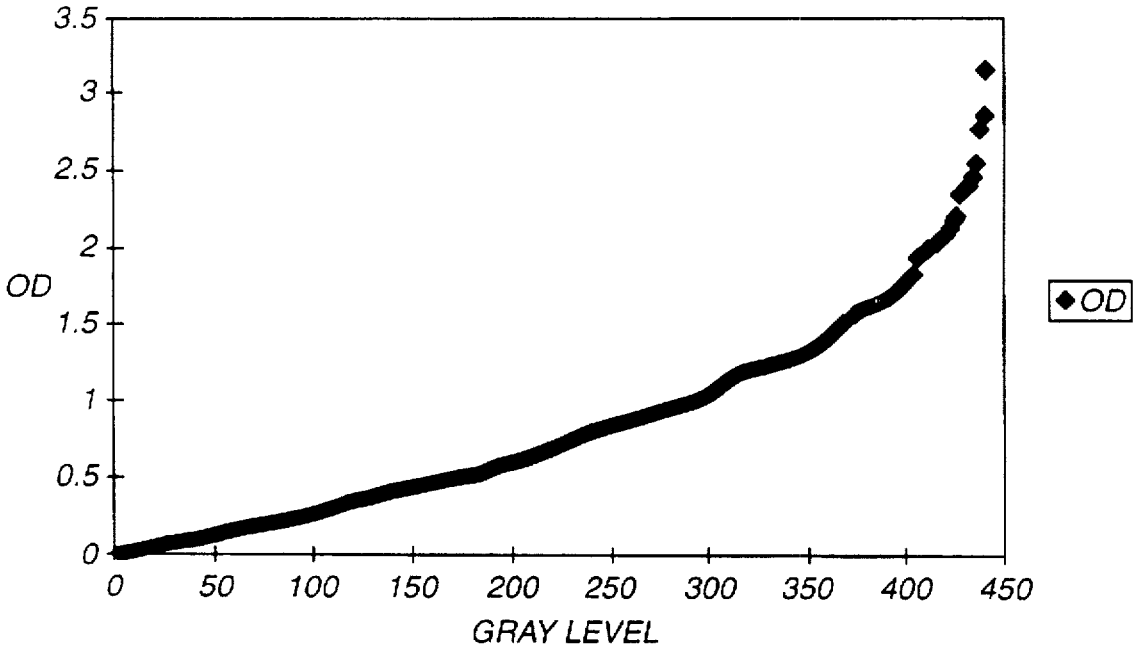
FIG. 5 shows a response curve of optical density versus ink level for Comparative Case # 1.

The null image element is not used for full coverage. The highest optical density is achieved with two drops of the highest density ink and one drop of the next highest density in a single subpixel. A theoretical total of 440 unique gray levels are achieved, however, in practice the gray level are not achieved because this requires placement of subpixels with no ink next to subpixels with three drops of ink. In this comparative case the relief is large and the collapses and spreads. This would especially be noticed in the ability to hold line of minimum density in a field of maximum density. This case yields totally unsatisfactory results due to the loss of gradient and the loss of qualititative image quality. FIG. 5 illustrates optical density versus ink level for the comparative case.

Inventive Case #2

Figure 6:
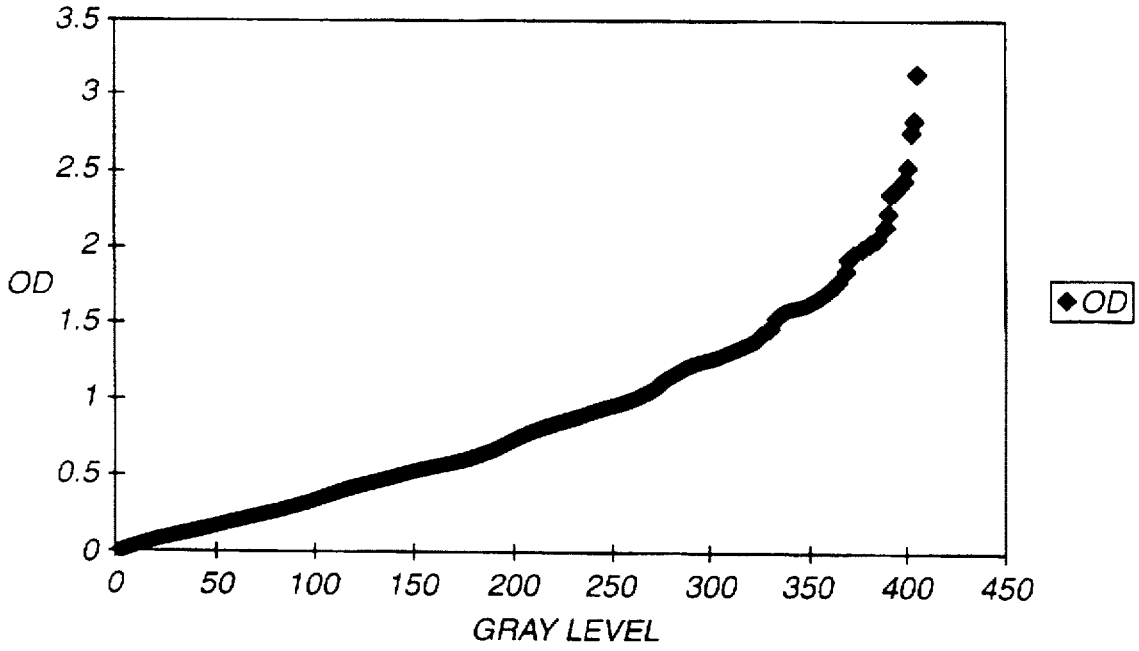
FIG. 6 shows a response curve of optical density versus ink level for Inventive Case # 2.

The inventive case differs from Comparative Case #1 by the use of the null image element which is used to obtain full coverage, even in large areas of minimum density. In this case fewer theoretical levels, a total of 405, are achieved, however, all of these levels are usable in forming an image. The thickness of ink layers differs by no more than two ink drop thicknesses in any adjacent subpixels. Collapse of the relief and dot spread are much improved relative to Comparative Case #1. A thin line of minimum density on a maximum density filed will hold. Although the theoretical number of gray levels may be decreased, the practical number of usable gray levels will be much higher. FIG. 6 illustrates optical density versus ink level for the inventive case.

Comparative Case #1 and Inventive Case #2 both illustrate suitable gradient response curves as illustrated in FIGS. 5 and 6. Comparative Case #1 provides an image quality which is unacceptable while Inventive Case #2 provides an image quality which is superior with highly resolved edges.

Claimed is:

1. An apparatus for recording a gradient image on transparent media comprising:

at least one solid phase change ink;

a solid null image element;

a printing head capable of melting said solid phase change ink to form a molten phase change ink and melting said solid null image element to form a molten null image element and depositing drops of said molten phase change ink and drops of said molten null image element in subpixels to form an imagewise pattern;

a transfer surface capable of receiving said imagewise pattern of said molten phase change ink and said molten null image element from said printing head to form a malleable phase change ink and a malleable null image element in said imagewise pattern on said transfer surface; and a media capable of receiving said malleable phase change ink and said malleable null image element in said imagewise pattern from said transfer surface.

2. The apparatus for recording a gradient image on transparent media of claim 1 wherein said solid null image element has an optical density of less than 0.15.

3. The apparatus for recording a gradient image on transparent media of claim 2 wherein said solid null image element has an optical density of less than 0.10.

4. The apparatus for recording a gradient image on transparent media of claim 1 wherein said at least one solid phase change ink comprises a first imaging ink and a second imaging ink.

5. The apparatus for recording a gradient image on transparent media of claim 4 wherein said at least one solid phase change ink comprises said first imaging ink said second imaging ink and a third imaging ink.

6. The apparatus for recording a gradient image on transparent media of claim 4 wherein said first imaging ink has an optical density of at least 0.08 to no more than 0.40.

7. The apparatus for recording a gradient image on transparent media of claim 6 wherein said first imaging ink has an optical density of at least 0.2 to no more than 0.40.

8. The apparatus for recording a gradient image on transparent media of claim 4 wherein said second imaging ink has an optical density of more than 0.40 to no more than 0.90.

9. The apparatus for recording a gradient image on transparent media of claim 8 wherein said second imaging ink has an optical density of more than 0.70 to no more than 0.90.

10. The apparatus for recording a gradient image on transparent media of claim 5 wherein said third imaging ink has an optical density of at least 1.2 to 5.0.

11. The apparatus for recording a gradient image on transparent media of claim 10 wherein said third imaging ink has an optical density of at least 1.2 to 2.0.

12. The apparatus for recording a gradient image on transparent media of claim 4 wherein said first imaging ink has an optical density ($P_1$) defined by a formula:

$$P_1 \leqq N_a \cdot n \cdot m \cdot P_n + D$$

wherein:

D is a maximum deviation between optical density steps allowable;

$P_n$ is an optical density of said null image element;

$N_a$ is a number of ink drops allowed per subpixel for each ink (a); and n and m multiplied together define a number of subpixels per superpixel.

13. The apparatus for recording a gradient image on transparent media of claim 12 wherein said second imaging ink has an optical density ($P_2$) defined by a formula:

$$P_2 \leqq N_a \cdot n \cdot m \cdot P_n + N_1 \cdot n \cdot m \cdot P_1 + D.$$

14. The apparatus for recording a gradient image on transparent media of claim 13 further comprising a third imaging ink wherein said third imaging ink has an optical density ($P_3$) defined by a formula:

$$P_3 \leqq N_a n \cdot m \cdot P_n + N_1 \cdot n \cdot m \cdot P_1 + N_2 \cdot n \cdot m \cdot P_2 + D.$$

15. The apparatus for recording a gradient image on transparent media of claim 1 wherein said subpixels comprise a first subpixel and a second subpixel adjacent to said first subpixel with a proviso that a number of said drops in said first subpixel is no more than two more than a number of said drops in said second subpixel.

16. The apparatus for recording a gradient image on transparent media of claim 15 wherein said number of said drops in said first subpixel is no more than one more than said number of said drops in said second subpixel.

17. An apparatus for recording a gradient image on media comprising:

a set of solid phase change inks comprising:

a first solid phase change ink with an optical density defined by a formula:

$$P_1 \leqq N_a \cdot n \cdot m \cdot P_n + D;$$

a second solid phase change ink with an optical density ($P_2$) defined by a formula:

$$P_2 \leqq N_a \cdot n \cdot m \cdot P_n + N_1 \cdot n \cdot m \cdot P_1 + D;$$

and a third solid phase change ink has an optical density ($P_3$) defined by a formula:

$$P_3 \leqq N_a n \cdot m \cdot P_n + N_1 \cdot n \cdot m \cdot P_1 + N_2 \cdot n \cdot m \cdot P_2 + D;$$

wherein:

D is a maximum deviation between optical density steps allowable;

$P_n$ is an optical density of said null image element;

$N_a$ is a number of ink drops allowed per subpixel for each ink (a); and n and m multiplied together define a number of subpixels per superpixel;

a solid null image element;

a printing head capable of melting said set of solid phase change inks to form a set of molten phase change inks and melting said solid null image element to form a molten null image element and depositing said set of molten phase change inks and said molten null image element in a molten imagewise pattern;

a transfer surface capable of receiving said molten imagewise pattern from said printing head to form a malleable imagewise pattern on said transfer surface; and a media capable of receiving said malleable imagewise pattern from said transfer surface.

18. The apparatus for recording a gradient image on media of claim 17 wherein:

said first solid phase change ink has an optical density of at least 0.08 to no more than 0.40;

said second solid phase change ink has an optical density of more than 0.40 to no more than 0.90; and said third solid phase change ink has an optical density of at least 1.2 to 5.0.

19. An apparatus for recording a gradient image on transparent media comprising:

a set of solid phase change inks comprising:

a first solid phase change ink has an optical density of at least 0.08 to no more than 0.40 for a 19 μm thick drop;

a second solid phase change ink has an optical density of more than 0.40 to no more than 0.90 for a 19 μm thick drop;

a third solid phase change ink has an optical density of at least 1.2 to 5.0 for a 19 μm thick drop;

a solid null image element wherein said null image element has an optical density of less than 0.15 for a 19 μm thick drop;

a printing head capable of melting said set of solid phase change inks and melting said solid null image element to form a set of molten phase change inks and a molten null image element and depositing said set of molten phase change inks and said molten null image element in a molten imagewise pattern;

a transfer surface capable of receiving said molten imagewise pattern from said printing head to form a malleable imagewise pattern on said transfer surface; and a media capable of receiving said malleable imagewise pattern from said transfer surface.

* * * * *

UNITED STATES PATENT AND TRADEMARK OFFICE

CERTIFICATE OF CORRECTION

PATENT NO. : 5,754,209
DATED : May 19, 1998
INVENTOR(S) : Thomas, Jules W.; Apple, Bernard A.

It is certified that error appears in the above-identified patent and that said Letters Patent is hereby corrected as shown below:

Column 10,
Line 60, insert after "ink" the following: "comprising a first imaging ink wherein said first imaging ink has an optical density of at least 0.08 to 0.40".

Column 11,
Line 19, delete -- a first imaging ink -- and substitute therefore "said first imaging ink".
Lines 25-27, delete -- 6. The apparatus for recording a gradient image on transparent media of claim 4 wherein said first imaging ink has an optical density of at least 0.08 to no more than 0.40. --
Line 29, delete -- claim 6 -- and substitute therefore "claim 1".

Signed and Sealed this

Fifth Day of February, 2002

*Attest:*

*Attesting Officer*

JAMES E. ROGAN
*Director of the United States Patent and Trademark Office*